US010787992B1

(12) United States Patent
Chen et al.

(10) Patent No.: US 10,787,992 B1
(45) Date of Patent: Sep. 29, 2020

(54) REGENERATIVE DISPLACER FOR USE IN A STIRLING ENGINE

(71) Applicant: NATIONAL CHENG KUNG UNIVERSITY, Tainan (TW)

(72) Inventors: Wen-Lih Chen, Tainan (TW); Yueh-Heng Li, Tainan (TW); Yu-Ting Wu, Tainan (TW); Chao-Wei Huang, Tainan (TW)

(73) Assignee: National Cheng Kung University, Tainan (TW)

( * ) Notice: Subject to any disclaimer, the term of this patent is extended or adjusted under 35 U.S.C. 154(b) by 0 days.

(21) Appl. No.: 16/422,092

(22) Filed: May 24, 2019

(51) Int. Cl.
*F02G 1/057* (2006.01)
*F02G 5/02* (2006.01)

(52) U.S. Cl.
CPC ..... *F02G 1/057* (2013.01); *F02G 5/02* (2013.01)

(58) Field of Classification Search
CPC ..... F02G 1/057; F02G 5/02
See application file for complete search history.

(56) References Cited

U.S. PATENT DOCUMENTS 6,131,644 A * 10/2000 Kohara ..... F02G 1/057 165/10
2017/0122626 A1* 5/2017 Schwartz ..... F25B 9/14 165/10

OTHER PUBLICATIONS

"Performance of a beta-configuration heat engine having a regenerative displacer" (Year: 2009).*

* cited by examiner

*Primary Examiner* — Shafiq Mian
(74) *Attorney, Agent, or Firm* — Rosenberg, Klein & Lee

(57) ABSTRACT

A regenerative displacer for use in a stirling engine includes two opposite covers with respective through openings, a body engaging the covers to define an accommodation space therein, a regenerator disposed in the accommodation space, and a rod inserted through the regenerator and one of the covers into a cooling portion of the stirling engine. The regenerator has a plurality of channels. Each channel has two open ends and a heat collecting net engaging each open end. Working gas passing through the regenerative displacer can be concentrated at the open ends and can absorb and release heat quickly because of the heat collecting nets, thereby increasing the efficiency of heat exchange and a temperature difference of the working gas in a thermodynamic cycle. Accordingly, pressure is increased to facilitate a quick reciprocation of a power piston of the stirling engine, and this increases output power and saves energy.

4 Claims, 5 Drawing Sheets

REGENERATIVE DISPLACER FOR USE IN A STIRLING ENGINE

BACKGROUND OF THE INVENTION

1. Field of the Invention

This invention relates to a thermodynamic auxiliary instrument and relates particularly to a regenerative displacer for use in a stirling engine.

2. Description of the Related Art

Stirling engine is a high-efficiency energy conversion instrument that utilizes the principle of heat engine which allows gas to expand and contract in response to a change in temperature to further reciprocate a power piston to generate power. In addition, any form of external heat source can be applied to execute the mechanical equivalent of heat. Thus, type and source of external heat source are not limited. Any energy source can make the stirling engine work as long as a temperature of the energy source is increased to be high enough, and that is especially suitable for use in the present which is confronted by problems of energy shortage and environmental pollution.

Stirling engine is usually presented in two ways. One is to use two power pistons to achieve the compression and expansion of working gas and to force the working gas to move back and forth. Another one is to use one power piston to compress and expand working gas and use one displacer to force the working gas to further flow back and forth. The displacer is usually formed with a heat conduction material which is provided by winding a stainless steel wire or a copper wire into an irregular cylindrical shape and placed inside the displacer, so that the heat of the expanded working gas that is increased in a heating portion can be temporarily stored in the heat conduction material when the working gas passes through the displacer into a cooling portion. Hence, the heat which needs to be removed in the cooling portion is reduced. Meanwhile, the working gas can absorb the heat stored in the heat conduction material during the previous cycle when passing the displacer into the heating portion after being cooled and compressed in the cooling portion, whereby the working gas is pre-heated to increase a speed of heating the working gas in the heating portion. Therefore, the efficiency of the heat conduction material affects the entire output efficiency and performance of the stirling engine, and that makes the heat conduction material to be an integral part to the stirling engine.

Since the heat conduction material is provided with the irregular winding shape, only a small area of the heat conduction material contacts the working gas and that results in poor efficiency of heat exchange between the working gas and the heat conduction material and causes reduced pressure. Therefore, the displacer cannot be pushed and accelerated smoothly and effectively, and simultaneously affects the motion of the power piston. The start time of the stirling engine is extended. Meanwhile, the energy consumed during the driving process is increased, and the generated power is decreased. If the temperature of the heating portion is increased in order to increase the output power, the cost will be raised and that needs to be improved.

SUMMARY OF THE INVENTION

The object of this invention is to provide a regenerative displacer for use in a stirling engine capable of providing preferable effect of heat conduction, increasing the efficiency of heat exchange and the efficiency of a regenerator, and increasing a temperature difference of working gas in a thermodynamic cycle to increase pressure for facilitating a quick reciprocation of a power piston and further increase output power greatly.

The regenerative displacer for use in a stirling engine of this invention is disclosed. The stirling engine comprises a cylinder and a regenerative displacer disposed therein to divide the cylinder into a heating portion and a cooling portion. An expansion chamber is formed in the heating portion and a compression chamber is formed in the cooling portion. A power piston is disposed apart from the regenerative displacer. The regenerative displacer comprises a body which has a peripheral wall enclosing an accommodation space, a first cover and a second cover respectively engaging two ends of the peripheral wall, a regenerator disposed in the accommodation space, and a rod inserted through the regenerator and the second cover into the cooling portion. Surfaces of the first cover and the second cover are penetrated by a plurality of through openings respectively. The regenerator has a plurality of spaced channels each has two opposite open ends. Each open end communicates with the accommodation space and is covered by a heat collecting net. Thus, working gas sealed in the cylinder can be concentrated at the open ends when passing through the regenerator and can absorb and release heat quickly by an assistance of the heat collecting nets, thereby providing preferable effect of heat conduction, and increasing the efficiency of heat exchange effectively and the efficiency of the regenerator greatly. Further, a temperature difference between a maximum temperature and a minimum temperature of the working gas generated in a thermodynamic cycle is increased, thereby increasing the generated pressure to quickly reciprocate the power piston, and that increases output power greatly.

Preferably, each channel is parallel to the rod.

Preferably, each channel is inclined to the rod.

Preferably, a number of net holes formed on each heat collecting net is between 2 and 3 per square inch.

DETAILED DESCRIPTION OF THE PREFERRED EMBODIMENTS

Figure 3:
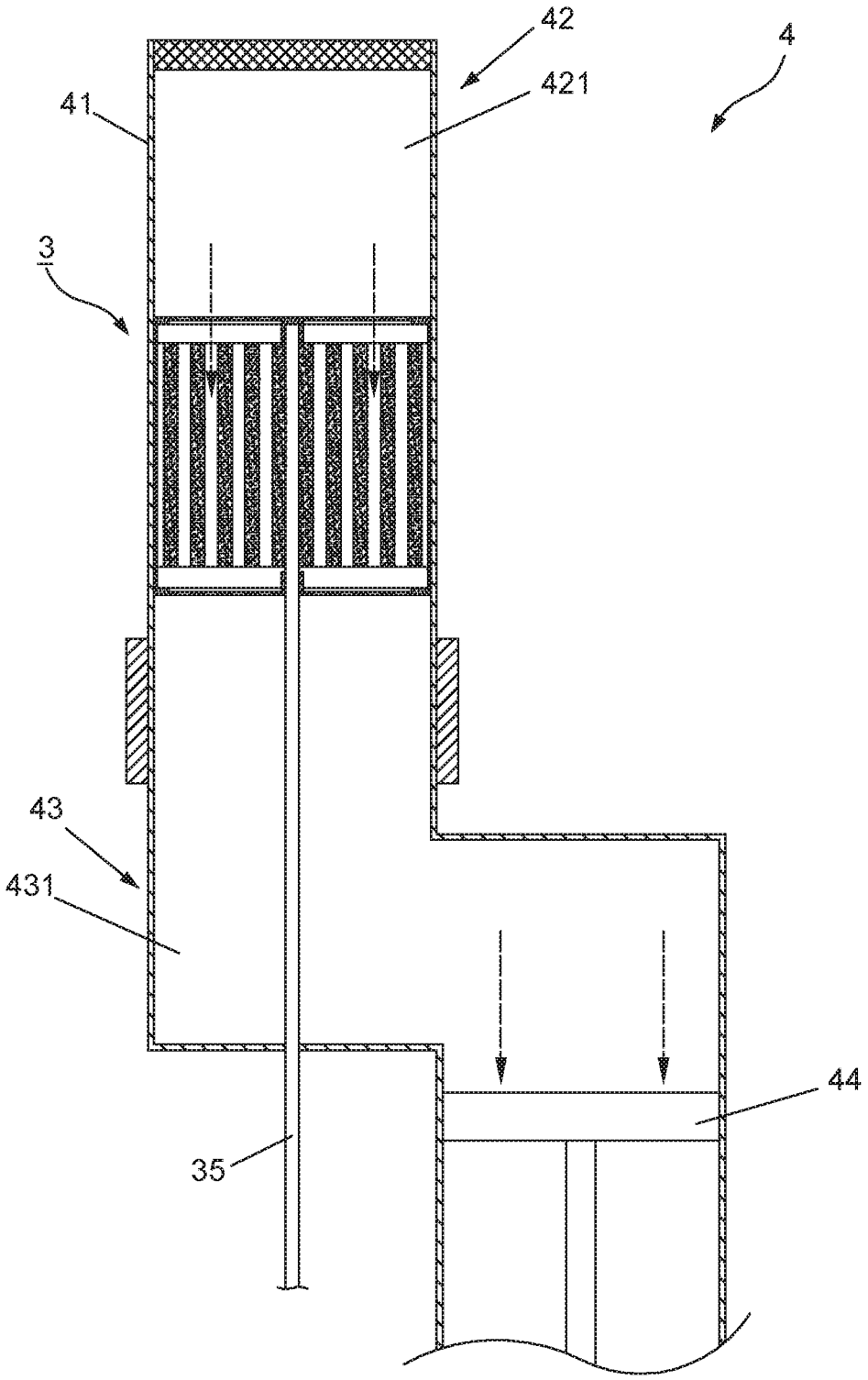
FIG. 3 is a schematic view showing the regenerative displacer is forced to move toward the cooling portion and synchronously push the power piston.

Referring to FIG. 3, a first preferred embodiment of a regenerative displacer 3 for use in a stirling engine 4 is disclosed. The stirling engine 4 comprises a cylinder 41 which is filled with working gas and a regenerative displacer 3 which is loosely fitted in the cylinder 41 so that the regenerative displacer 3 can move in the cylinder 41 easily. The regenerative displacer 3 divides the cylinder 41 into a heating portion 42 where an expansion chamber 421 is surrounded and a cooling portion 43 where a compression chamber 431 is surrounded. A power piston 44 is located in the compression chamber 431 and disposed at a distance from the regenerative displacer 3.

Figure 1:
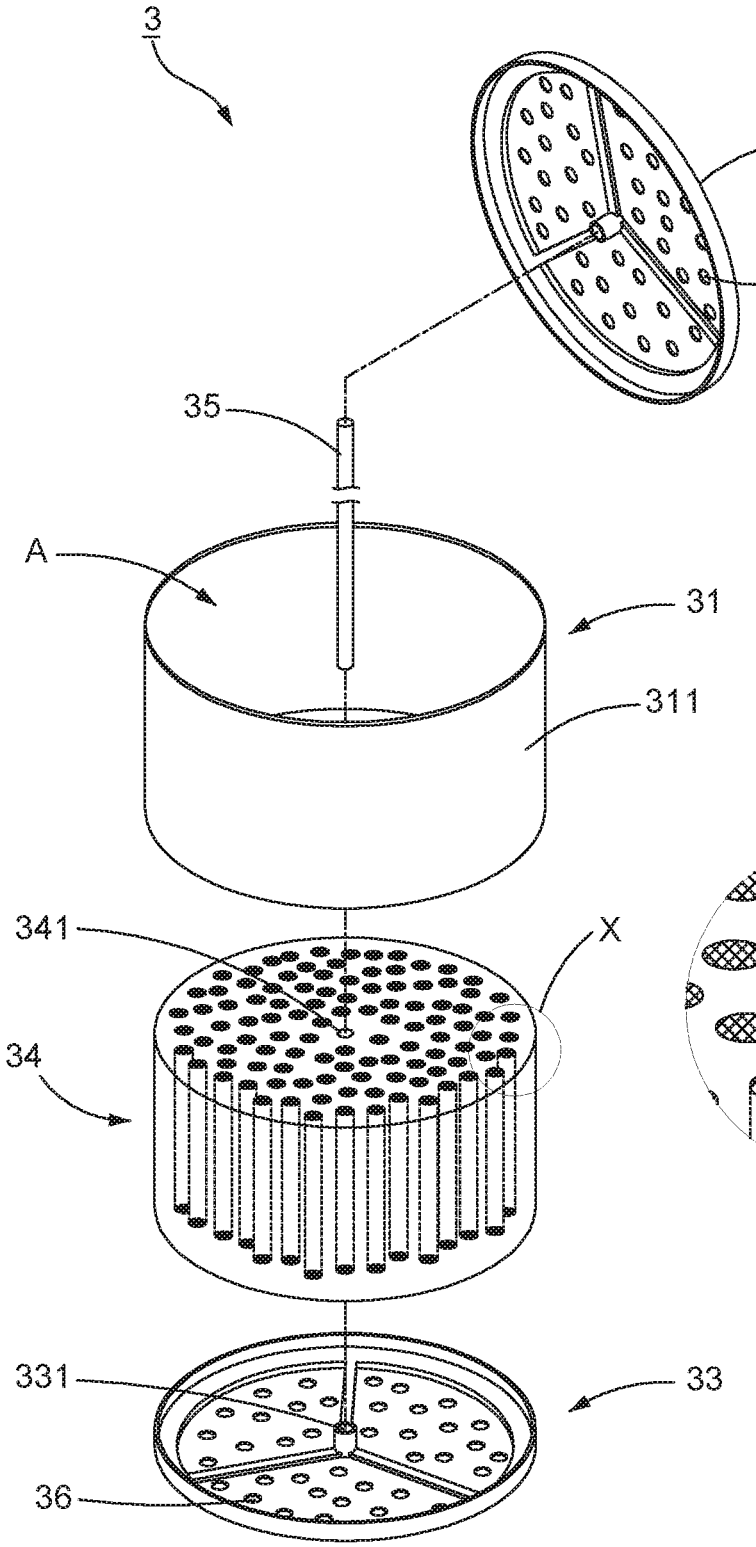
FIG. 1 is an exploded view showing a first preferred embodiment of this invention.
Figure 1A:
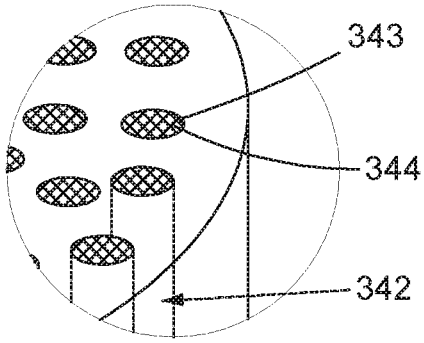
FIG. 1A is an enlarged view showing a partial element of FIG. 1.
Figure 2:
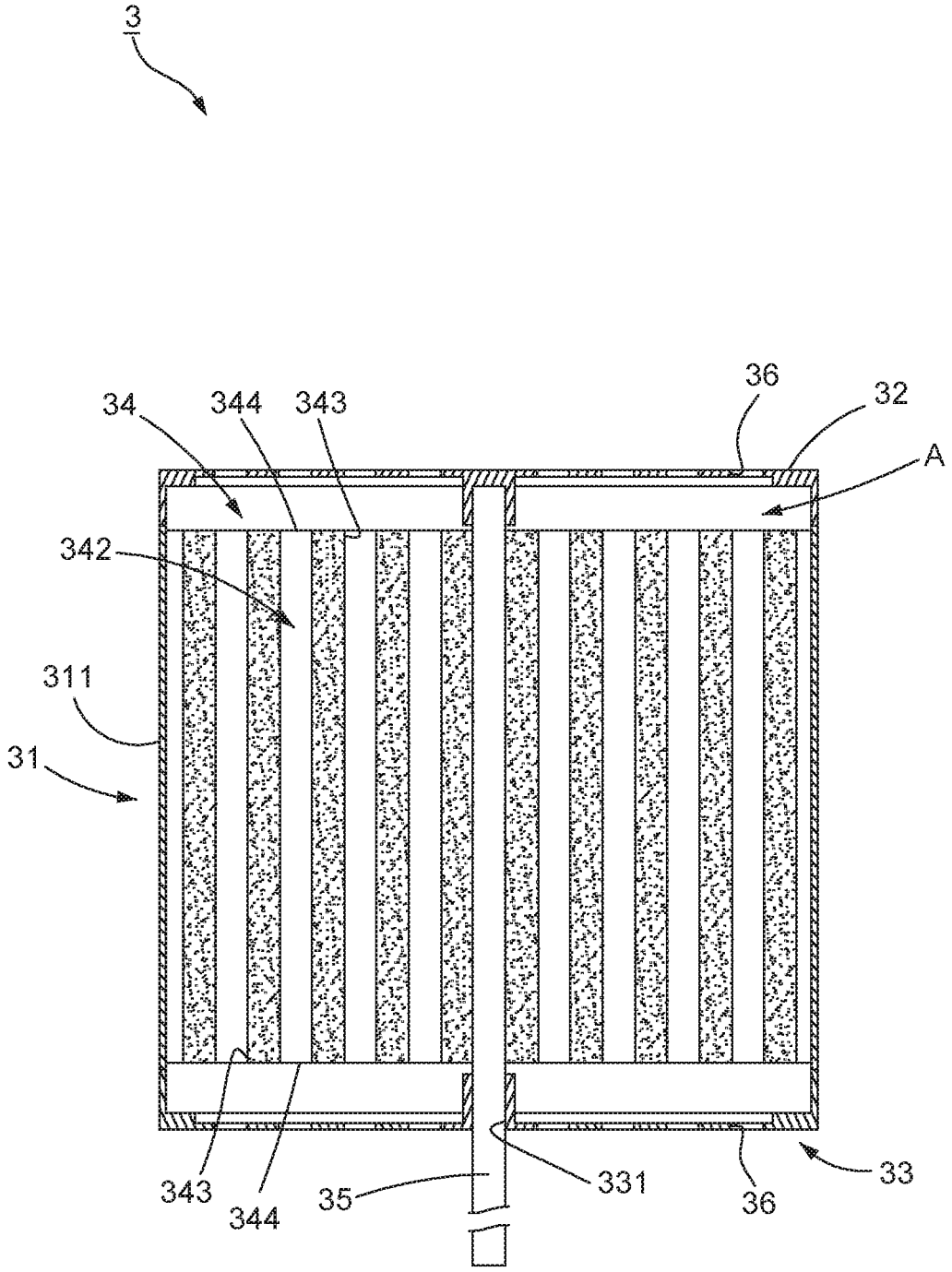
FIG. 2 is a cross-sectional view showing the regenerative displacer.

Referring to FIG. 1 and FIG. 2, the regenerative displacer 3 comprises a body 31 which has a peripheral wall 311 by which an accommodation space A is surrounded, a first cover 32 engaging one end of the peripheral wall 311, a second cover 33 engaging another end of the peripheral wall 311 and opposite to the first cover 32, a regenerator 34 disposed in the accommodation space A, and a rod 35 penetrating through a slot 341 formed in the regenerator 34 and a bore 331 formed in the second cover 33 into the cooling portion 43 of the stirling engine 4 as shown in FIG. 3. A surface of the first cover 32 and a surface of the second cover 33 are respectively formed with a plurality of through openings 36. Referring to FIG. 1A which is the enlarged view of the encircled portion X indicated in FIG. 1 shows that the regenerator 34 has a plurality of channels 342 spaced from each other. Each channel 342 has two opposite open ends 343. Each open end 343 communicates with the accommodation space A and is engaged with a heat collecting net 344. Namely, the heat collecting net 344 is covered at a surface of each open end 343. In this preferred embodiment, each channel 342 is parallel to the rod 35. In addition, a number of net holes formed on each heat collecting net 344 is between 2 and 3 per square inch.

Referring to FIG. 2 and FIG. 3, in order to start the stirling engine 4, an external heat source (not shown) is applied to increase a temperature of the heating portion 42, and synchronously heat the working gas which is sealed in the expansion chamber 421 to allow the working gas to expand and increase its volume. The expanded working gas then moves toward the cooling portion 43 and simultaneously passing through the regenerative displacer 3, whereby the regenerative displacer 3 is also forced to move toward the cooling portion 43. When the working gas passes through the through openings 36 of the first cover 32 and the open ends 343 into the channels 342 and then leaves the regenerative displacer 3 into the compression chamber 431 through the open ends 343 and the through openings 36 of the second cover 33, the open ends 343 assist in concentrating the working gas. Meanwhile, the working gas exchanges heat with the heat collecting net 344 surrounding each open end 343 to allow the heat collecting nets 344 to absorb and store the heat of the working gas effectively, thereby providing the preferable effect of heat conduction and quickly pushing the regenerative displacer 3. Because the heat collecting nets 344 remove part of the heat of the working gas, it allows the working gas to be cooled rapidly and lowers its volume effectively, and that facilitates the cooling and compression operation of the working gas in the compression chamber 431. When the working gas flows to the compression chamber 431, the working gas moves the power piston 44, and simultaneously activate a crank shaft, a gear wheel or a flywheel (not shown) that connect to the power piston 44 to operate.

Figure 4:
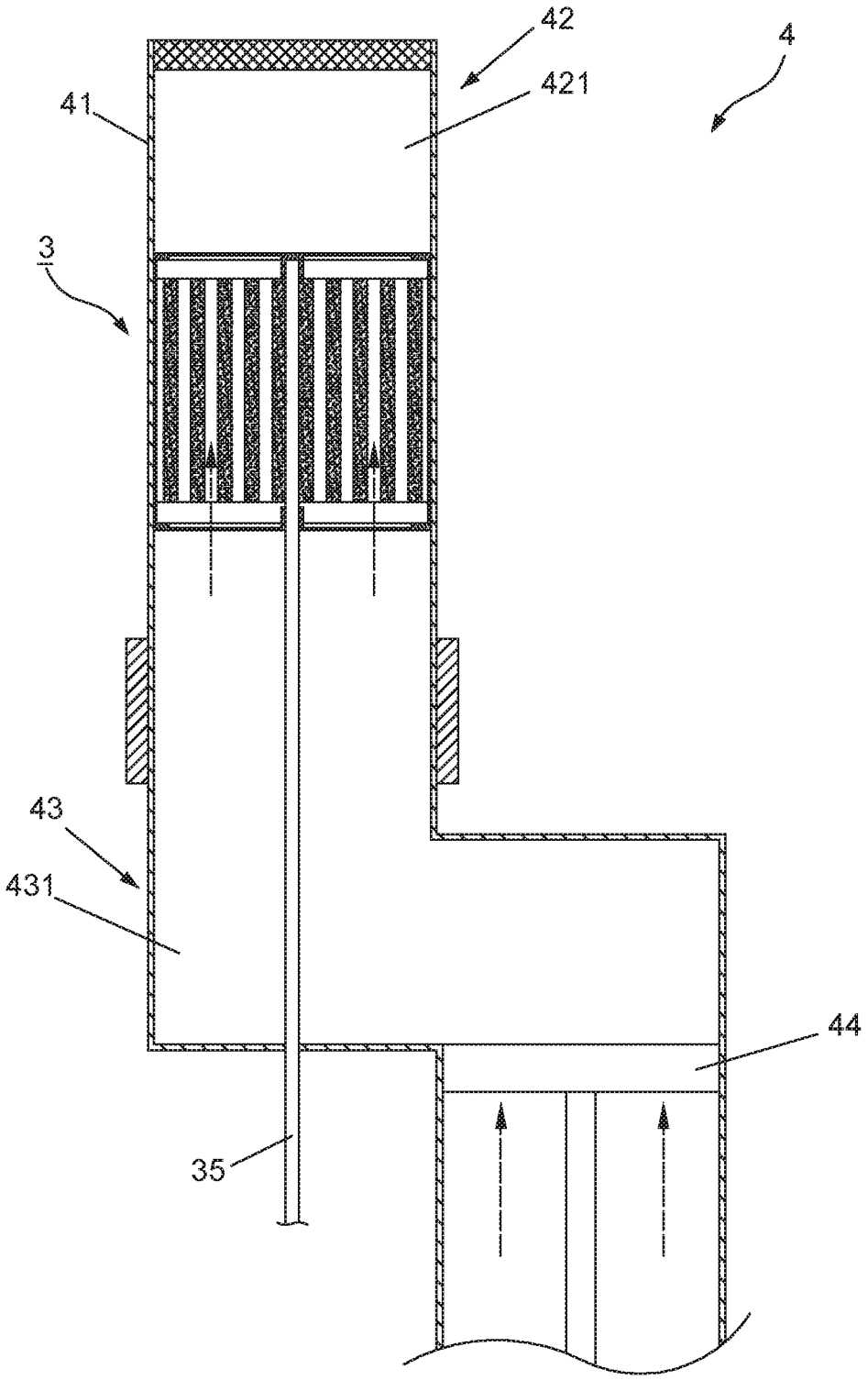
FIG. 4 is a schematic view showing the regenerative displacer is forced by the power piston to move toward the heating portion.

Referring to FIG. 2 and FIG. 4, after the working gas is cooled and contracted in the compression chamber 431, namely the volume of the working gas is decreased, the power piston 44 starts to move toward the regenerative displacer 3 and compress the working gas. When the working gas is compressed by the power piston 44 to flow from the compression chamber 431 through the regenerative displacer 3 into the expansion chamber 421, the working gas gradually passes the through openings 36 of the second cover 33 and the open ends 343 into the channels 342 and flows into the expansion chamber 421 through the open ends 343 and the through openings 36 of the first covers 32. The working gas then absorbs the heat stored in the heat collecting net 344 which is engaged at each open end 343 in the previous thermodynamic cycle when the working gas passes through the open ends 343, thereby pre-heating the working gas effectively that facilitates the heating and expansion operation of the working gas in the expansion chamber 421. Simultaneously, the regenerative displacer 3 is moved by the working gas to further subject the rod 35 which also connects with the crank shaft, the gear wheel or the flywheel to move toward the heating portion 42. Hence, the repeated thermodynamic cycles allow the power piston 44 and the regenerative displacer 3 to move back and forth stably in the cylinder 41 to execute the quick reciprocation and force the crank shaft, the gear wheel or the flywheel to operate and generate output power. Therefore, the working gas contacts all heat collecting nets 344 uniformly to facilitate the heat collecting nets 344 to collect and store the heat of the working gas to allow the working gas to increase or decrease the temperature and volume quickly, thereby enhancing the heating effect of the heating portion 42 and the cooling effect of the cooling portion 43. Moreover, the temperature difference between a maximum temperature and a minimum temperature of the working gas in the thermodynamic cycle is increased, thereby greatly increasing the generated pressure to push the regenerative displacer 3 and the power piston 44 quickly, increasing the efficiency of the regenerator 34, and further increasing the output power. In addition, energy consumption caused when the stirling engine 4 operates is reduced and saved. Furthermore, the structure of the regenerative displacer 3 is very simple, thereby decreasing the cost greatly and reducing the entire volume and weight to achieve lightweight and lower cost.

Figure 5:
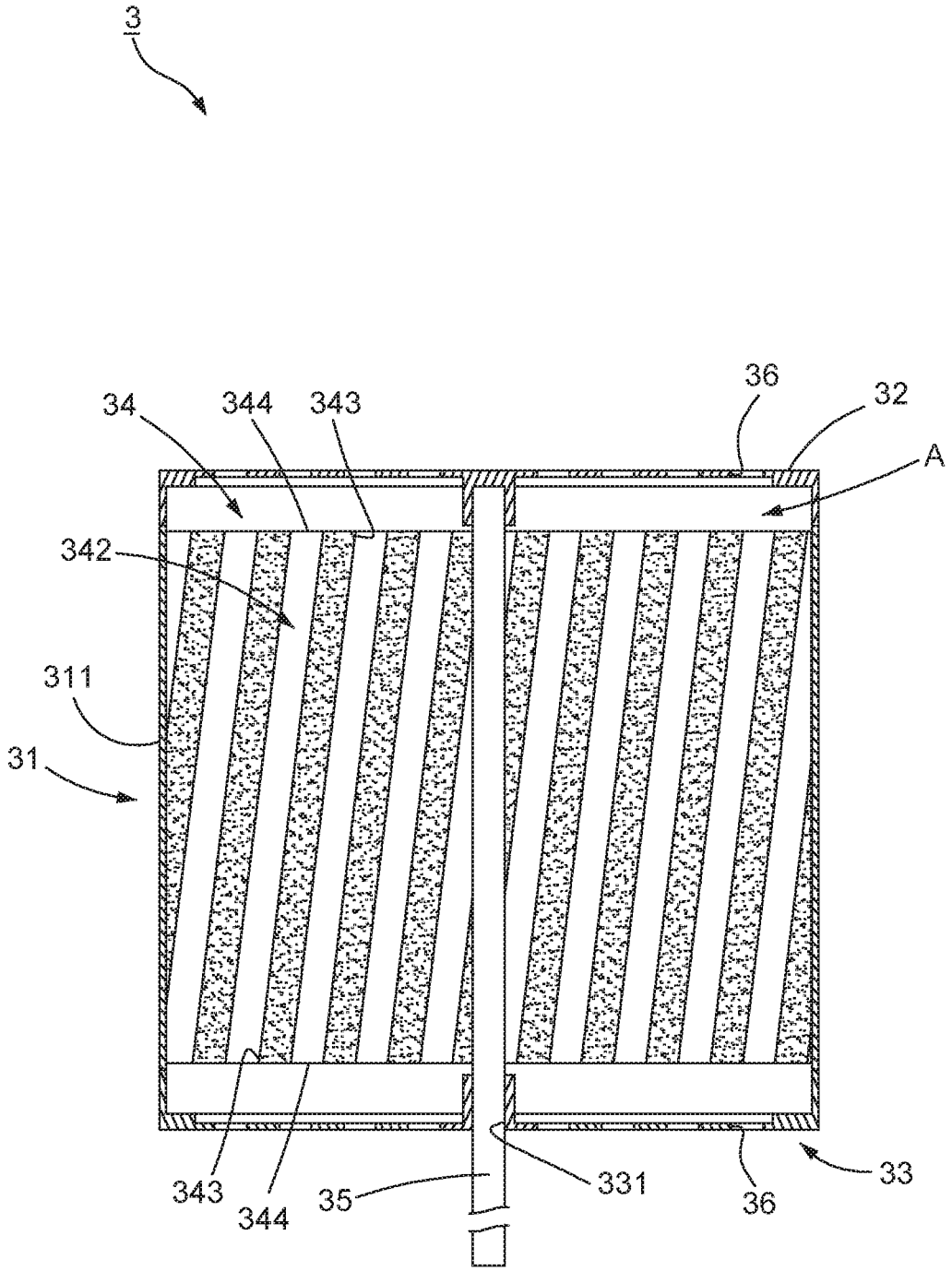
FIG. 5 is a cross-sectional view showing a second preferred embodiment of this invention characterized by the inclined channels.

Referring to FIG. 5 shows a second preferred embodiment of the regenerative displacer 3 for use in the stirling engine 4 of this invention. The correlated elements and the concatenation of elements, the operation and objectives of the second preferred embodiment are the same as those of the first preferred embodiment. This embodiment is characterized in that each channel 342 is formed to be inclined to the rod 35. Therefore, the inclined disposition increases a length of the channels 342, thereby increasing the contact time of the channels 342 and the working gas to further increase the effect of heat conduction of the regenerative displacer 3 and increase the efficiency of heat exchange. Thus, the working gas can be pre-heated and pre-cooled through the regenerative displacer 3 quickly. The temperature difference between the maximum temperature and the minimum temperature of the working gas in the thermodynamic cycle is also increased, thereby increasing the generated pressure that can push the regenerative displacer 3 and the power piston 44 quickly and further increase the output power and reduce the energy consumption.

To sum up, the regenerative displacer for use in the stirling engine of this invention takes an advantage that the regenerator is formed with the spaced channels each has two open ends which are engaged by the heat collecting nets respectively to concentrate the working gas and allow the working gas to absorb and release heat rapidly, thereby increasing the efficiency of heat exchange. Further, the temperature difference of the working gas is increased in the thermodynamic cycle, thereby generating larger pressure for reciprocating the power piston quickly to generate power, increasing the efficiency of the regenerator, and further increasing the output power greatly.

While the embodiments of this invention are shown and described, it is understood that further variations and modifications may be made without departing from the scope of this invention.

What is claimed is:

1. A regenerative displacer for use in a Stirling engine, said Stirling engine comprising:

a cylinder and a regenerative displacer disposed in said cylinder to thereby divide said cylinder into a heating portion and a cooling portion, an expansion chamber being enclosed by said heating portion and a compression chamber being enclosed by said cooling portion, a power piston being disposed in said compression chamber and being disposed at a distance from said regenerative displacer, wherein said regenerative displacer comprises a body having a peripheral wall by which an accommodation space is enclosed, a first cover and a second cover engaging and covering an upper end and a lower end of said peripheral wall of said body respectively, a regenerator disposed in said accommodation space, and a rod inserted through a slot formed in said regenerator and a bore formed in said second cover into said cooling portion of said Stirling engine, a plurality of through openings penetrating a surface of said first cover and a surface of said second cover respectively, said regenerator having a plurality of channels spaced from each other, each of said channels having two opposite open ends each communicating with said accommodation space, each of said opposite open ends being engaged with a heat collecting net; and wherein the heat collecting net being covered at said upper and said lower ends by said first and said second covers.

2. The regenerative displacer for use in the stirling engine as claimed in claim 1, wherein each of said plurality of channels is parallel to said rod.

3. The regenerative displacer for use in the stirling engine as claimed in claim 1, wherein each of said plurality of channels is inclined to said rod.

4. The regenerative displacer for use in the stirling engine as claimed in claim 1, wherein a number of net holes formed on each of said plurality of heat collecting nets is between 2 and 3 per square inch.

* * * * *